United States Patent [19]

Maeshima

[11] 4,302,850

[45] Dec. 1, 1981

[54] VEST WITH SLEEVES

[75] Inventor: Seiichi Maeshima, Nara, Japan

[73] Assignee: Descente Ltd., Osaka, Japan

[21] Appl. No.: 53,278

[22] Filed: Jun. 29, 1979

[30] Foreign Application Priority Data

Nov. 21, 1978 [JP] Japan ..... 53-159508[U]

[51] Int. Cl.[3] ..... A41B 1/04

[52] U.S. Cl. ..... 2/102; 2/108; 2/126

[58] Field of Search ..... 2/102, 126, 108

[56] References Cited

U.S. PATENT DOCUMENTS 4,006,495 2/1977 Jones ..... 2/126

4,122,553 10/1978 Pitkanen ..... 2/102

*Primary Examiner*—Doris L. Troutman

*Attorney, Agent, or Firm*—Oblon, Fisher, Spivak, McClelland & Maier

[57] ABSTRACT

A garment including a vest and a pair of sleeves attached to the vest. Each sleeve has a closable opening near the shoulder of the vest and is adapted to be tucked up with its lower part passed through the opening and stowed inside the vest. The garment is convertible from a jacket-type vest with sleeves to an ordinary sleeveless vest, and vice versa, without the necessity of the wearer taking off the garment.

5 Claims, 3 Drawing Figures

VEST WITH SLEEVES

BACKGROUND OF THE INVENTION

1. Field of the Invention

This invention relates to a garment including a vest with sleeves.

2. Description of the Prior Art

Vests are popular winter town wear and sports wear e.g. for skiing or mountain climbing. They are usually made of quilting material, cloth or synthetic resin material to provide sufficient warmth to the body and shoulder portions of the wearer. A vest is normally sleeveless to permit free body movement of the wearer. In order to protect the arm portions of the wearer from the chill, however, it is often necessary to wear an additional sweater, light jacket or the like underneath the vest at the cost of hindering free body movement of the wearer.

SUMMARY OF THE INVENTION

It is therefore an object of the present invention to provide a garment of the type of a vest which protects not only the body and shoulder portions but also arm portions of the wearer from the cold without hindering free body movement of the wearer.

It is a further object of the invention to provide a garment which is convertible from an ordinary vest without sleeves to a jacket-type vest having sleeves, and vice versa.

Thus, the present invention provides a garment which includes a vest and a pair of sleeves attached to the vest, each sleeve having a closable opening near the respective shoulder of the vest and adapted to be tucked up with its lower part passed through the opening, and stowed inside the vest.

Preferably, the vest of the garment is provided with inside pockets adapted to receive the sleeves therein when the sleeves are not in use. The opening is made closable preferably by means of a slide fastener. It is preferred to attach the sleeves to the vest within its arm holes so that, when the sleeves are stowed inside the vest, the sleeves are completely concealed and the garment will give an outer appearance of an ordinary vest without sleeves. Further, it is preferred to provide an opening at the upper side of each sleeve so that, in a wearing mode a slider of the slide fastener attached to the opening will not usually contact with the vest and accordingly will not damage to the vest.

BRIEF DESCRIPTION OF DRAWING

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
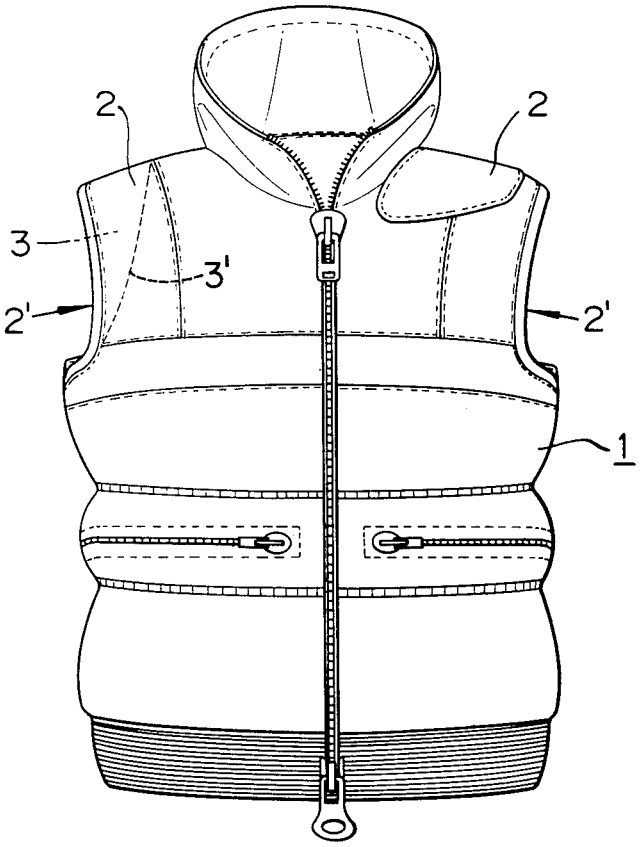
FIG. 1 illustrates the garment of the invention with its sleeves stowed inside the vest thereby giving an outer appearance similar to that of an ordinary vest having no sleeves.

Referring to the drawings, the garment of the present invention includes a vest 1 and a pair of sleeves 4 attached to the vest at inner central positions or gussets 3 of the respective shoulders 2 by seams 3'.

The sleeves 4 are attached to the vest 1 preferably within the respective arm holes 2' so that when the sleeves are stowed inside the vest, they are completely concealed and the garment gives an outer appearance of an ordinary sleeveless vest, as shown in FIG. 1.

Figure 2:
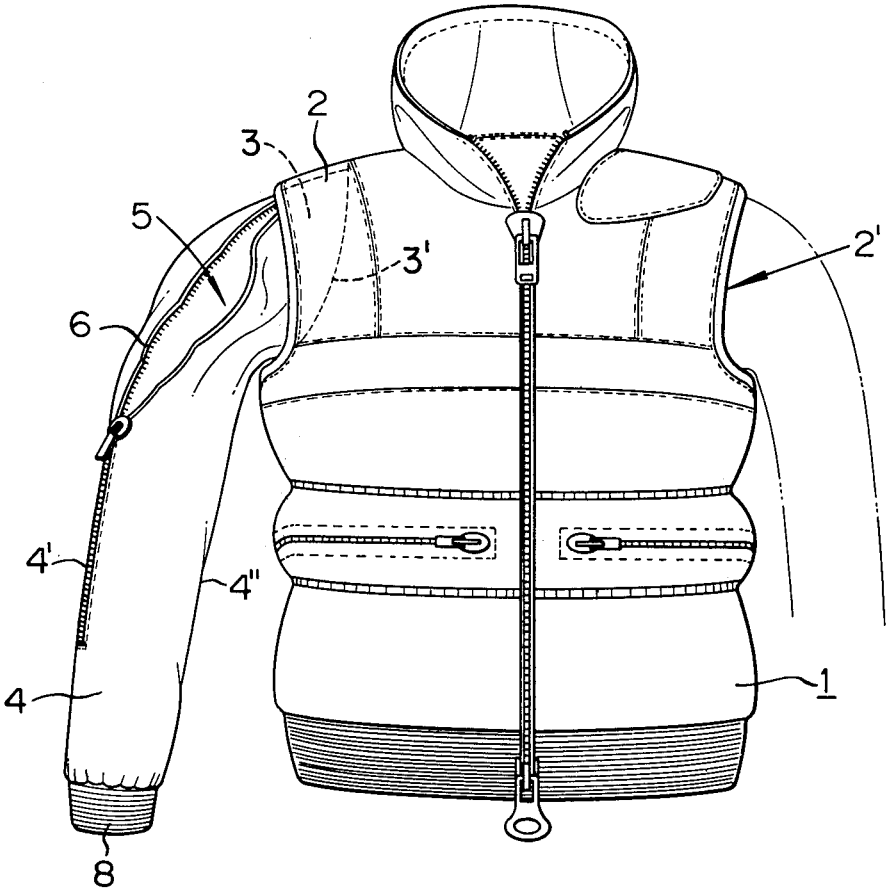
FIG. 2 illustrates the garment of the invention showing the vest with sleeves.

Referring to FIG. 2, each sleeve 4 has a closable opening 5 near the respective shoulder 2 of the vest 1, and is adapted to be tucked up with its lower part 8 passed through the opening and stowed inside the vest.

The opening 5 extends from the vicinity of the attaching point of the sleeve to a substantial length down along the sleeve, and it is made closable preferably by means of a slide fastener 6, as illustrated. The opening may be provided at the lower side 4'' of the sleeve. However, it is preferred to provide the opening at the upper side 4' of the sleeve, so that, in a wearing mode, the slider of the slide fastener 6 attached to the opening 5 will not usually contact with the vest 1 and accordingly will not damage the vest.

Figure 3:
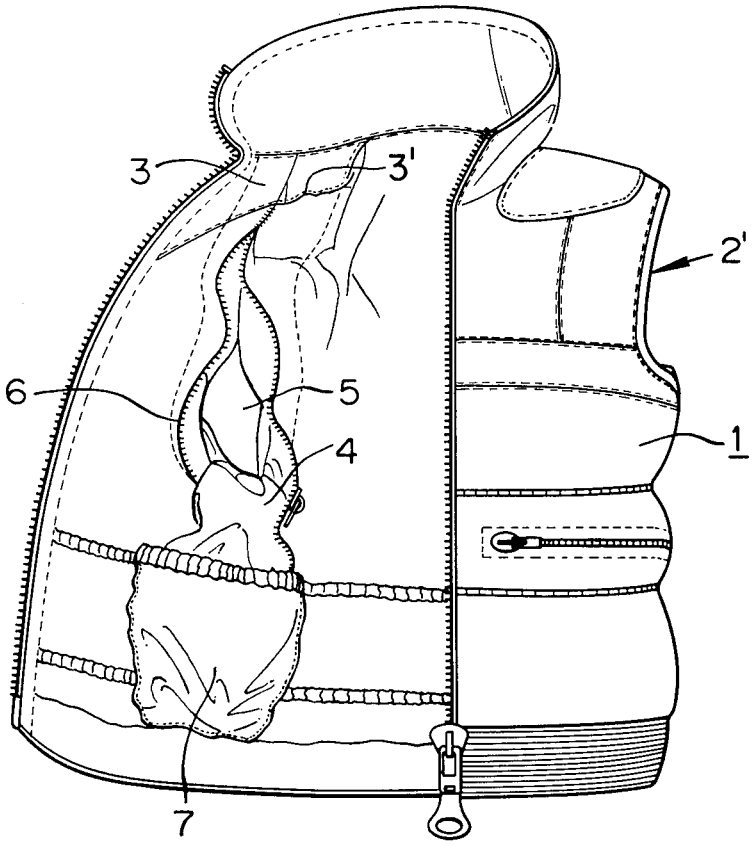
FIG. 3 illustrates the garment of the invention showing an inside pocket in which the sleeve is stowed.

Referring to FIG. 3, the vest 1 has inside pockets 7 adapted to receive the sleeves 4 therein.

The garment of the present invention is thus convertible from the vest-type wearing mode as shown in FIG. 1 to the jacket-type wearing mode as shown in FIG. 2, and vice versa. It is particularly advantageous that the garment is convertible without the necessity for the wearer taking off the garment.

The sleeves 4 are so designed that a person wearing the garment in the vest-type wearing mode as shown in FIG. 1, can pull out the lower part 8 of the sleeve from the pocket 7 and then from the opening 5, stretch the sleeve and pass his hand through the lower part 8 in a jacket-type wearing mode as shown in FIG. 2, and finally close the slide fastener 6 attached to the opening 5. In order to stow the sleeves 4 inside the vest 1, the slide fastener 6 is opened, the hand is withdrawn through the lower part 8 and the arm, hand are then pulled out through the opening 5 and the lower part 8 is then passed through the opening 5 and pulled in through the arm hole 2' and stowed in the inside pocket 7 as shown in FIG. 3. By passing the lower part 8 through the opening 5, the sleeve 4 is stowed into the pocket in a turned or reversed state as shown in FIG. 3.

When the sleeve 4 is pulled out from the vest 1 for use, the turned or reversed sleeve 4 returns to a normal state. The pocket 7 inside the vest 1 receives the sleeves 4 thereby avoiding their hanging and moving around the body.

Thus, the garment of the present invention has an advantage that it can easily be convertible from the vest-type wearing mode to the jacket-type wearing mode, and vice versa, without the necessity of the wearer removing the garment.

Further, when the sleeves are stowed inside i.e. in a vest-type wearing mode, the garment of the present invention gives an outer appearance similar to that of an ordinary vest having no sleeves.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A garment comprising:

a vest having arm holes formed therein and having first and second shoulder portions, each of said first and second shoulder portions including inner central portions;

a pair of reversible sleeves; and means for attaching said pair of reversible sleeves to the vest within said arm holes formed within said vest and to said inner central portions of said first and second shoulder portions, each of said pair of sleeves further comprising a closable opening means formed therein exclusively along the length of each sleeve adjacent said first and second shoulder portions of the vest for allowing passage of a lower part of each of said pair of sleeves through said opening means and stowing inside said vest such that each of said pair of sleeves is reversible while still being worn by the wearer of the vest and such that each of said pair of sleeves is completely concealed when stowed inside said vest.

2. The garment as claimed in claim 1 further comprising pockets secured to opposite interior portions of the vest adapted to receive the sleeves therein.

3. The garment as claimed in claims 1 or 2 wherein the closable opening means includes a slide fastener.

4. The garment as claimed in claims 1 or 2 said closeable opening means being positioned at an upper side portion of each sleeve.

5. A garment as set forth in claims 1 or 2 wherein said closable opening means extends from a point adjacent said first and second shoulder portions of the vest along the length of each sleeve to a point on each sleeve located a substantial length down each sleeve.

* * * * *